US005712240A

United States Patent [19]

Tyerech et al.

[11] Patent Number: 5,712,240

[45] Date of Patent: Jan. 27, 1998

[54] AQUEOUS CLEANING COMPOSITIONS PROVIDING WATER AND OIL REPELLENCY TO FIBER SUBSTRATES

[75] Inventors: Michael Richard Tyerech, Fort Lee; Jeanne Marie Weller, Glen Rock, both of N.J.; Andrew Francis Colurciello, Jr., Newburgh, N.Y.; Tracy Ann Ryan, Rivervale, N.J.

[73] Assignee: Reckitt & Colman Inc., Montvale, N.J.

[21] Appl. No.: 724,441

[22] Filed: Oct. 1, 1996

[30] Foreign Application Priority Data

Apr. 25, 1996 [GB] United Kingdom ..... 9608503
Jul. 19, 1996 [GB] United Kingdom ..... 9615180

[51] Int. Cl.[6] ..... C11D 1/722; C11D 1/12; C11D 3/37; C11D 7/50

[52] U.S. Cl. ..... 510/424; 510/276; 510/290; 510/278; 510/340; 510/341; 510/350; 510/352; 510/360; 510/421; 510/423; 510/432; 510/475

[58] Field of Search ..... 510/276, 290, 510/278, 340, 341, 350, 352, 360, 421, 423, 424, 432, 475

[56] References Cited

U.S. PATENT DOCUMENTS 4,560,487 12/1985 Brinkley ..... 252/8.75
4,565,641 1/1986 Chang et al. ..... 252/8.75
4,566,981 1/1986 Howells ..... 252/8.8
4,668,406 5/1987 Chang ..... 252/8.75
4,668,726 5/1987 Howels ..... 524/225
5,202,049 4/1993 Bingham ..... 252/162
5,370,919 12/1994 Fieuws et al. ..... 428/96

FOREIGN PATENT DOCUMENTS

WO93/01348 A1 1/1993 WIPO .

OTHER PUBLICATIONS

WPI Abstract Acc No.: 85–034494/06 and JP 59228076 A.

Copy of GB Search Report for Application No. GB 9615180.8 dated 4 Nov. 1996.

Copy of GB Search Report for Application No. GB9615821.7 dated 7 Nov. 1996.

*Primary Examiner*—Paul Lieberman
*Assistant Examiner*—Charles Boyer
*Attorney, Agent, or Firm*—Fish & Richardson P.C.

[57] ABSTRACT

Aqueous carpet cleaning compositions are described which provide an effective cleaning effect and further impart water and oil repellent characteristics to carpet surfaces and carpet fibers treated with the same. Processes for the production of such compositions, as well as methods for their application are also disclosed.

37 Claims, No Drawings

AQUEOUS CLEANING COMPOSITIONS PROVIDING WATER AND OIL REPELLENCY TO FIBER SUBSTRATES

The present invention relates to aqueous cleaning compositions which clean, as well as provide water and oil repellency to fibers and fiber substrates. More particularly the present invention relates to pumpable and pourable aqueous cleaning compositions which include fluorosurfactants and which provide oil and water repellency to carpet fibers treated with the compositions, and which are particularly suitable for cleaning carpets and carpet fibers.

Textile substrates, particularly carpets and carpeted surfaces are commonly encountered in both domestic and public environments. Carpets provide a pleasant surface covering, especially flooring surfaces, and in some cases wall surfaces, which surface covering is durable, helps deaden sound transmission, are somewhat thermally insulating, and are readily applied. In order to retain their attractive appearance, such carpet surfaces require maintenance, particularly cleaning. Such cleaning may be of a general nature such as by vacuuming, wherein loose particulates are withdrawn from said carpet surface, as well as more intensive cleaning operations, including general shampooing and cleaning, as well as spot cleaning where a limited area or locus surrounding a stain is treated in order to remove it.

The consequence of such intensive cleaning operations is very frequently the reduction or removal of anti-staining characteristics which may have been imparted to the carpet fiber at the time of its production, such as by treatment by a wide variety of known compounds. The purpose of such compounds, and such carpet treatment compositions is to provide the carpet fibers with a degree of repellency, particularly to oil and water. Both oil and water, jointly and severally, are major constituents in a wide variety of staining materials, such as: beverages, food stuffs, as well as other edible and/or imbibable compositions. Further staining compositions include any variety number of other materials which may come into contact with the carpet and which are entrained amongst the carpet fibers and/or upon the carpet fiber surface. Unfortunately, such carpet fiber treatments and treatment compositions when applied frequently wear away with time due to the normal wear and tear associated with such an installed carpet surface, and/or may be deleteriously degraded and/or removed by one or more chemicals or other compositions which may be used in the intensive cleaning of a carpet surface.

Australian Patent No. AU-A-42875/89 describes an aqueous carpet cleaning compositions which includes a small amount of a perfluoropropionate and a perfluoroalkyl phosphate as well as mixtures thereof, a small amount of a nonionic, anionic or amphoteric surfactant or mixture thereof, a pH adjusting agent, and water, as well as minor amounts of other conventional additives.

GB Patent No. 2,200,365-A describes a detergent composition which can be used in cleaning soiled carpet surfaces which includes between 0.01–50% by weight of a silicone or siloxane compound in conjunction with a 50% and greater proportion of one or more conventional surfactants.

U.S. Pat. No. 4,279,796 describes a carpet cleaning composition as well as a specific process for its application which carpet cleaning composition is an aqueous dispersion containing a non-fluorinated vinyl polymer, a perfluoroalkyl ester of carboxylic acid, and hydrogen peroxide.

U.S. Reissue Pat. No. 30,337 as well as U.S. Pat. No. 4,043,923 describes cleaning and treatment compositions which may be used for the treatment of amongst other substrates, carpet surfaces. Compositions described therein include as an essential constituent certain novel detergent compatible organic fluorochemical compounds which are described as being useful in otherwise conventional cleaning compositions containing anionic or nonionic surfactants which are used as detersive constituents. These particular fluorochemical compounds are recited as imparting both oil repellency and water repellency to treated carpet samples.

U.S. Pat. No. 4,145,303 and U.S. Pat. No. 3,901,727 both to Loudas describes a water dilutable alkaline cleaning composition which includes amongst its constituents at least one zinc or zirconium coordination complex which is water dispersible and capable of combining with substantially all of the acid radicals which are otherwise present in the composition, as well as up to about 1.5 parts of at least one fluorochemical compound having acid functionality which fluorochemical compound is capable of imparting water and oil repellency to the substrate.

U.S. Pat. No. 5,370,919 to Fieuws describes a composition effective for imparting water and oil repellency as well as stain resistance and dry soil resistance to textiles, carpets, as well as other substrates which contains a fluoroaliphatic radical containing a polyoxyalkylene compound, an anti-soiling agent, and up to 60% by weight of an environmentally acceptable water miscible organic solvent as well as water. However, the Fieuws compositions fail to suggest or to include any surfactant constituents. The compositions of Fieuws additionally require that both the a fluoroaliphatic radical containing a polyoxyalkylene compound and the anti-soiling agent be present in an amounts of 0.3–30% by weight.

U.S. Pat. No. 5,439,610 to Ryan et al, discloses aqueous cleaning compositions which include sodium lauryl sulfate, ethylene glycol monohexyl ether, a flurosurfactant, a carboxylated polymer salt and tetrasodium ethylenediamine tetraacetate in specific weight ranges. The said cleaning compositions are recited to be useful cleaners for carpet surfaces, and to provide an oil repellent characteristic thereto.

While the prior art has proposed many such cleaning compositions, they have not uniformly met with success. Accordingly there remains a real and continuing need in the art for the provision of improved cleaning compositions, particularly cleaning compositions useful in the cleaning of carpet fibers and carpet surfaces. There is a further need in the art for improved carpet cleaning compositions which impart both water repellency and/or repellency to carpet fibers and carpet surfaces treated with such a composition.

Accordingly certain deficiencies of such prior art compositions are addressed and overcome by the present invention.

The present invention provides aqueous cleaning compositions which are particularly suitable for cleaning of and imparting of oil and water repellent characteristics to substrates, especially carpet surfaces and carpet fibers, which comprise the following constituents:

(a) fluoroaliphatic radical-containing poly(oxyalkylene) compound;

(b) anionic surfactant selected from alkyl sulfates, alkyl benzene sulfates, and alkane sulfonates as well as salt forms thereof;

(c) organic solvent;

(d) water.

The compositions according to the invention may optionally, but in some cases desirably include one or more additives selected from:

(e) preservatives, coloring agents such as dyes and pigments, opacifiers, fragrances, anti-foaming agents, pH adjusting agents, buffer compositions, anti-soiling agents and resoiling inhibitors, chelating agents, optical brighteners, further solvents or surfactants, as well as one or more further fluorosurfactant compositions. A further optional additive which is in certain cases advantageously included in the inventive compositions are nonionic surfactant selected from alkoxylated primary alcohols and alkoxylated secondary alcohols as well as salt forms thereof. A yet further optional additive which is in certain cases is advantageously included in the inventive compositions are anti-resoiling compositions especially one or more based on fluorinated or non-fluorinated acrylic polymers.

These aqueous compositions are efficacious cleaning compositions which provide not only a cleaning benefit to treated surfaces, particularly to carpeted surfaces and carpet fibers but which also impart both water and oil repellency to treated substrates.

The fluoroaliphatic radical-containing poly(oxyalkylene) compound of constituent (a) can be a fluoroaliphatic oligomer or polymer (the term oligomer hereinafter includes polymer unless otherwise indicated) represented by the general formulae (1) and (2):

$$(R_f)_sZ[(R^3)_yZ'B]_t \quad (1)$$

$$[(R_f)_sZ[(R^3)_yZ'B']_t]_w \quad (2)$$

where $R_f$ is a fluoroaliphatic radical,

Z is a linkage through which $R_f$ and $(R^3)_y$ moieties are covalently bonded together, $(R^3)_y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 1, preferably 1 to 125 and can be as high as 180 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B, or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

In formulas (1) and (2), where there were a plurality of $R_f$ radicals, these may be either the same or different. This also applies to a plurality of Z, Z', $R^3$, B, B', and, in formula (2), a plurality of s, y and t.

$R_f$ is a stable, inert, nonpolar, preferably saturated monovalent moiety which is both oleophobic and hydrophobic. A fluorinated oligomer preferably comprises from 1 to about 25 $R_f$ groups and preferably comprises about 5 percent to about 30 percent, and more preferably about 8 percent to about 20 percent fluorine by weight based on the total weight of the oligomer, the loci of the fluorine being essentially in the $R_f$ groups. $R_f$ preferably contains at least about 3 carbon atoms, more preferably 3 to about 20 carbon atoms, and most preferably about 6 to about 12 carbon atoms. Rican contain straight chain, branched chain, or cyclic alkyl groups. $R_f$ is preferably free of polymerizable olefinic unsaturation and can optionally contain caternary heteroatoms such as oxygen, divalent or hexavalent sulfur, or nitrogen. It is preferred that each $R_f$ contain about 40% to about 78% fluorine by weight, more preferably about 50% to about 78% fluorine by weight. The terminal portion of the $R_f$ group contains a fully fluorinated terminal group. This terminal group preferably contains at least 7 fluorine atoms, e.g., $CF_3CF_2CF_2$; $(CF_3)_2CF$; $CF_2SF_5$, or the like.

Perfluorinated aliphatic groups, i.e., those of the formula $C_nF_{2n+1}$, are the most preferred embodiments of $R_f$.

Generally, the oligomers will contain about 5 to 40 weight percent, preferably about 10 to 30 weight percent, of carbon-bonded fluorine.

In the poly(oxyalkylene) radical, $(R^3)_y$, $R^3$ is an oxyalkylene group having 2 to 4 carbon atoms, such as $—OCH_2CH_2—$, $—OCH_2CH_2CH_2—$, $—OCH_2CH_2CH_2CH_2—$, $—OCH(CH_3)CH_2—$, and $—OCH(CH_3)CH(CH_3)—$, the oxyalkylene units in said poly(oxyalkylene) being the same, as in poly(oxypropylene), or present as a mixture, as in a heteric straight or branched chain or randomly distributed oxyethylene, oxypropylene and oxybutylene units or as in a straight or branched chain of blocks of oxyethylene units and/or blocks of oxypropylene units and/or blocks of oxybutylene units. The poly(oxyalkylene) chain can be interrupted by or include one or more catenary linkages. Where said catenary linkages have three or more valences, they provide a means for obtaining a branched chain of blocks of oxyalkylene units. The poly(oxyalkylene) radicals in the oligomers can be the same or different, and they can be pendent. The molecular weight of the poly(oxyalkylene) radical can be about 500 to 2,500 and higher, e.g., 100,000 to 200,000 or higher.

The function of the linkages Z and Z' is to covalently bond the fluoroaliphatic radicals, $R_f$, the poly(oxyalkylene moieties, $(R^3)_y$ and radicals B and B' together in the oligomer. Z and Z' can be a valence bond, for example, where a carbon atom of a fluoroaliphatic radical is bonded or linked directly to a carbon atom of the poly(oxyalkylene) moiety. Z and Z' each can also comprise one or more linking groups such as polyvalent aliphatic and polyvalent aromatic, oxy, thio, carbonyl, sulfone, sulfoxy, phosphoxy, amine, and combinations thereof, such as oxyalkylene, iminoalkylene, imimoarylene, sulfonamido, carbonamido, sulfonamidoalkylene, carbonamidoalkylene, urethane, urea, and ester. The linkages Z and Z' for a specific oligomer will be dictated by the ease of preparation of such an oligomer and the availability of necessary precursors thereof.

Illustrative linking groups Z are alkylene groups, such as ethylene, isobutylene, hexylene, and methylenedicyclohexylene, having 2 to about 20 carbon atoms, aralkylene groups, such as

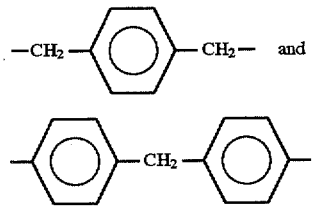

having up to 20 carbon atoms, arylene groups, such as tolylene, $—C_6H_3(CH_3)—$, poly(oxyalkylene) groups, such as —$(C_2H_4O)_yC_2H_4$— where y is 1 to about 5, and various combinations of these groups. Such groups can also include other hetero moieties (besides —O—), including —S— and —N—. However, Z is preferably free of groups with active hydrogen atoms.

From the above description of Z and Z' it is apparent that these linkages can have a wide variety of structures, and in fact where either is a valence bond, it does not even exist as a structure. However large Z or Z' is, the fluorine content (the locus of which is $R_f$) is in the aforementioned limits set forth in the above description, and in general the total Z and Z' content of the oligomer is preferably less than 10 weight percent of the oligomer.

The monovalent terminal organic radical, B, is one which is covalently bonded through Z', to the poly(oxyalkylene) radical.

Though the nature of B can vary, it preferably is such that it complements the poly(oxyalkylene) moiety in maintaining or establishing the desired solubility of the oxyalkylene. The radical B can be a hydrogen atom, an acyl radical such as $C_6H_5C(O)$—, an alkyl radical, preferably lower alkyl, such as methyl, hydroxyethyl, hydroxypropyl, mercaptoethyl and aminoethyl, or an aryl radical, such as phenyl, chlorophenyl, methoxyphenyl, nonylphenyl, hydroxphenyl, and aminophenyl. Generally, Z'B will be less than 50 weight percent of the $(R^3)_yZ'B$ moiety.

The fluoroaliphatic radical-containing poly(oxyalkylene) compounds used in the compositions according to the present invention can be prepared by a variety of known methods, such as by condensation, free radical, or ionic homopolymerization or copolymerization using solution, suspension, or bulk polymerization techniques, e.g., see "Preparative Methods of Polymer Chemistry", Sorenson and Campbell, 2nd ed., Interscience Publishers.

Many of such fluoroaliphatic radical-containing poly (oxyalkylene) compounds are presently commercially available.

In one preferred embodiment of the invention the fluoroaliphatic radical-containing poly(oxyalkylene) compound contains a fluoroalkyl radical having 3 to 20 carbon atoms, wherein perfluoroalkyl radicals are particularly preferred.

In a further preferred embodiment the fluoroaliphatic radical-containing poly(oxyalkylene) compound can contain 1 to 15, but more preferably 1–2, and most preferably an average of about 1.5 ethylene and/or propylene radicals per molecule of the fluoroaliphatic radical-containing poly (oxyalkylene) compound.

Particularly preferred the fluoroaliphatic radical-containing poly(oxyalkylene) compound include those which may be represented by the following general structural formula (3):

$$C_aF_{2a+1}N(CH_3)(W)_3(A)_nB^-\ X^+ \quad (3)$$

in which:

B represents a water soluble group selected from sulfate, sulfonate, carboxylate, phosphate, phosphonate or halogen group;

W represents a lower alkyl group especially a —$CH_2$—, —$CH_2CH_2$— and/or —$CH_2CH_2CH_2$—;

A represents an ethoxy ($OC_2H_4$), propoxy ($OC_3H_6$), and/or butoxy ($OC_4H_8$) or a mixture of two or more such groups;

X+ is a salt forming counterion such as an organic counterion, or an inorganic counterion such as an alkali or alkaline earth metal counterion.

n represents a value of between 1 and 8, preferably is a value of from 1 to 5 inclusive, and most preferably is a value of from about 1 to about 3;

a represents a value of between 1 and 12, preferably is a value of from 5 to 12 inclusive, and most preferably is a value of from about 6 to about 9;

A particularly advantageous fluoroaliphatic radical-containing poly(oxyalkylene) compound which may be used as constituent (a) of the present invention is one which is presently commercially available as Fluorad® FC-138 from the Minnesota Mining and Manufacturing Co. (St. Paul, Minn.) which is described as being a composition consisting essentially of: 37% wt. water, 27% wt. of the fluorochemical salt, 18% wt. of isopropyl alcohol, and 18% wt. of 2-butoxyethanol. While not wishing to be bound to the following representation, it is believed that this advantageous fluoroaliphatic radical-containing poly(oxyalkylene) compound is a fluorochemical salt is extremely similar to or which may be represented by the following general structural formula (4):

$$C_8F_{17}N(CH_3)(CH_2)_3(A)_nOSO_2^-\ X^{30} \quad (4)$$

in which:

n represents a value of between 1 and 3, preferably is a value of from 1 to 2 inclusive, and most preferably is a value of about 1.5;

A represents an ethoxy ($OC_2H_4$), propoxy ($OC_3H_6$), or a mixture of such groups, but preferably represents ethoxy;

$X^+$ is a salt forming counterion such as an alkali or alkaline earth metal counterion.

The fluoroaliphatic radical-containing poly(oxyalkylene) compound according to constituent (a) is included in the compositions of the invention in amounts of from between about 0.001% wt. to about 3% wt.; more desirably the fluoroaliphatic radical-containing poly(oxyalkylene) compound is present in an amount of from 0.1% wt. and 0.5% wt. based on the total weight of the composition. It is understood that such fluoroaliphatic radical-containing poly (oxyalkylene) compound may be provided with further constituents, such as water, one or more surfactants in a commercial preparations.

As a further essential constituent, a wide variety of known ionic surfactants may be included in the present inventive compositions as constituent (b). Such known useful anionic surfactants include organic sulfuric reaction products having in their molecular structure an alkyl group containing from about 8 to about 20 carbon atoms and a sulfonic acid or sulfuric acid ester group. Included in the term "alkyl" is the alkyl portion of aryl groups. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkylpolyglycosides, diphenyl sulfonate derivatives, alkyl phosphates, alkyl ether phosphates, acyl sarconsinates, acyl isethionates, and N-acyl taurates. Generally, the alkyl or acyl radical in these various compounds comprise a carbon chain containing 8 to 20 carbon atoms, and preferably comprise a carbon chain containing 12 to 20 carbon atoms. The alkyl or acyl radical may be linear or branched. Mixtures of two or more anionic surfactants may be used as well.

Further exemplary anionic surfactants which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Other anionic surfactants not particularly enumerated here may also find use in conjunction with the compounds of the present invention.

Preferred as the anionic surfactant constituent are alkyl sulfates, alkyl benzene sulfates, and alkane sulfonates, particularly water soluble salts thereof and especially preferred those containing from 11 to 17 carbon atoms in their alkyl radical, which may be straight chained or branched. Useful water soluble salts which are effective in producing salt forms of the surfactant include, but are not limited to: sodium, potassium, ammonium, magnesium, chloride and mono-, di- and tri-$C_2$–$C_3$ alcohol ammoniums, amine and aminoalcohol salts forms. Preferably, however, the salts are selected from sodium, magnesium, and ammonium of which sodium salts which are widely commercially available are most preferred as sodium chloride is widely used in the production of anionic surfactant salts. Such preferred anionic surfactant compositions are per se known, and may be obtained from a variety of sources. Desirably, the anionic surfactants are ones which may be characterized as having a low chloride content.

Exemplary preferred alkyl sulfates which are advantageously used in the aqueous compositions according to the present invention include those presently commercially available under the general tradename of STEPANOL® WA, and especially STEPANOL® WAQ which is described to be a sodium lauryl sulfate, STEPANOL® WA-Extra which is also described to be a sodium lauryl sulfate, and STEPANOL® WAC which is described as being a chloride-free sodium lauryl sulfate. Additional exemplary preferred alkyl sulfates which are advantageously used in the aqueous compositions according to the present invention include those presently commercially available under the general tradename of STANDAPOL® WA, and especially STANDAPOL® WAQ-LC which is described to be a low chloride content sodium lauryl sulfate surfactant preparation, and STEPANOL® WA-Extra which is also described to be a sodium lauryl sulfate. Further exemplary preferred commercially available alkyl sulfates surfactants include one or more of those available under the tradename RHODAPON® LCP from Rhône-Poulenc Co. An exemplary alkyl sulfate which is preferred for use is a sodium lauryl sulfate surfactant presently commercially available as RHODAPON® LCP from Rhône-Poulenc Co.

Exemplary preferred alkyl benzene sulfates which are particularly use in the compositions according to the invention which are presently commercially include one or more of those available under the tradename BIOSOFT® from Stepan Chem. Co. An exemplary alkyl benzene sulfates which is preferred for use is a sodium dodecyl benzene sulfonate surfactant presently commercially available as BIOSOFT® D-40 from Stepan Chem. Co.

Exemplary preferred alkane sulfonates which find advantageous use in the aqueous compositions according to the present invention which are presently commercially available include one or more of those available under the tradename HOSTAPUR® from Hoechst Celanese. An exemplary alkane sulfonate which is preferred for use is a secondary sodium alkane sulfonate surfactant presently commercially available as HOSTAPUR® SAS from Hoechst Celanese.

Desirably the anionic surfactant according to constituent (b) is also selected to be of a type which dries to a friable powder. Such a characteristic facilitates the subsequent removal of such anionic surfactants from a fibrous substrate, especially carpets and carpet fibers, such as by brushing or vacuuming.

The anionic surfactant according to constituent (b) may be included in the present inventive compositions in an amount of from 0.001–2% wt., but are desirably included in amounts of from 0.25% wt–1.5% wt., and most desirably are included in amounts of from 0.75% wt.–0.95% wt. with especially advantageous cleaning, and oil and water repellent properties being provided when the anionic surfactant is present in an amount of about 0.85% t. Such recited weights being based on the weight of actives in an anionic surfactant containing preparation.

The inventors have surprisingly observed that both the type of the anionic surfactant, and the amounts at which it is present in the cleaning compositions according to the invention must be critically selected and maintained. It has been observed that where the ratio of the anionic surfactant to the fluoroaliphatic radical-containing poly(oxyalkylene) compound is to be maintained in the range of from 1.5 to 6 parts of the anionic surfactant per 1 part of the fluoroaliphatic radical-containing poly(oxyalkylene) compound. It has been found by the inventors that the presence of lesser amounts of the anionic surfactant fails to provide adequate cleaning of certain soils, particularly hydrophobic or "oily" soils, while the presence of excessive amounts of the anionic surfactant has been observed to significantly reduce the ultimate water repellency characteristics imparted to a treated substrate.

The organic solvent which forms constituent (c) of the inventive compositions include one or more alcohols, glycols, acetates, ether acetates and glycol ethers. Exemplary alcohols useful in the compositions of the invention include $C_3$–$C_8$ alcohols which may be straight chained or branches, and which are specifically intended to include both primary and secondary alcohols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{20}$ glycol ethers By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$–$C_8$ primary and secondary alcohols. Many such organic solvents are presently commercially available under the tradenames CARBITOL® (Union Carbide Corp., Danbury Conn.) or CELLOSOLVE® (Union Carbide Corp., Danbury Conn.).

The inventors have found that mixtures of two or more individual organic solvent constituents imparts the benefit of both good cleaning and soil penetration and at the same time effective solubilization of the fluorochemical surfactant composition in the aqueous compositions according to the invention. This has been observed particularly wherein one or more of the solvents which form the organic solvent constituent is relatively hydrophobic, and/or includes a $C_3$–$C_8$, but preferably a $C_5$–$C_7$ carbon chain which has been observed to adequately penetrate oily soils. One such preferred mixture of organic solvents includes an organic solvent system which includes both at least one glycol ether with at least one $C_3$–$C_8$ primary or secondary alcohol, for example ethylene glycol hexyl ether with isopropanol; diethylene glycol methyl ether with isopropanol; as well as ethylene glycol hexyl ether with 1-pentanol. A farther preferred organic solvent system includes a mixture of two different glycol ethers, optionally further in conjunction with at least one a $C_3$–$C_8$ primary or secondary alcohol. Examples of such an organic solvent system include ethylene glycol hexyl ether in conjunction with diethylene glycol hexyl ether and optionally further with at least one a $C_3$–$C_8$ primary or secondary alcohol. In such organic solvent systems, the ratio of the ethylene glycol hexyl ether to diethylene glycol hexyl ether is limited to 1:0.1–1, but more desirably is limited to 1:0.15–0.5. A particularly advantageous organic solvent is ethylene glycol hexyl ether with diethylene glycol hexyl ether in a weight ratio of 1:0.1–1, which optionally includes one or more $C_3$–$C_8$ primary or secondary alcohols.

The organic solvent or solvent system according to constituent (c) is present in amounts of from about 0.001% wt. to about 8% wt. More desirably the organic solvent constituent is present in an amount of from about 0.5% wt. to about 3.25% wt., and most desirably is present in an amount of from 0.75% wt. to 2% wt.

As is noted above, the compositions according to the invention are aqueous in nature. Water forms constituent (d) of the invention and it is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The pH of the compositions of the invention are to be maintained within the range of from 8 to 10, but more desirably are to be maintained in the range of from 8.4–9.1. Such may be achieved and maintained by the use of appropriate pH adjusting agents such as are known to the art, examples of which are described in more particular detail below. The present inventors have noted that the maintenance of the pH within these ranges and in particular within the preferred ranges is particularly important in order to assure the phase stability of the aqueous compositions. It has been observed that this is particularly true where any fluoro-containing constituents are present as these are known to be difficult to solubilize in water, and more critically to maintain their solubility for extended periods of time. It has been observed that when such fluoro-containing constituents, particularly the fluorosurfactant composition, a fluoro-containing anti-resoiling agent such as the most preferred fluorinated acrylate copolymers, as well as further fluro-containing compounds precipitate from an aqueous composition that they are not readily reconstituted into such an aqueous composition by simple stirring or shaking, but need to be vigorously stirred or shaken in order to redisperse them. The aqueous compositions being taught herein feature excellent stability which provides superior shelf stability and thus an extended service life for any commercial product based on the same. Such a feature is not provided or is not forseen from many known prior art compositions having fluoro-containing compounds. Thus, the present inventive compositions provide a significant technical advantage thereover.

As has been previously noted, the compositions of the invention may include one or more optional constituents (e) many of which are recognized as conventional additives to such compositions.

One optional constituent which is desirably included are one or more chelating agents. Useful as chelating agents include those known to the art, including aminopolycarboxylic acids and salts thereof wherein the amino nitrogen has attached thereto two or more substituent groups. Preferred chelating agents include acids and salts, especially the sodium and potassium salts of ethylenediaminetetraacetic acid, diethylenetriaminepentaacetic acid, N-hydroxyethylethylenediaminetriacetic acid, and of which the sodium salts of ethylenediaminetetraacetic acid may be particularly advantageously used. Such chelating agents may be omitted, or they may be included in generally minor amounts such as from 0–0.6% wt. based on the weight of the chelating agents and/or salt forms thereof. Desirably, such a chelating agents are included in the present inventive composition in amounts from about 0.001% wt. to 0.6% wt., but are most desirably present in reduced weight percentages from about 0.001% to 0.3% wt.

The present inventors have observed that where the chelating agent is a salt of ethylenediaminetetraacetic acid, that its inclusion in amounts in excess of 0.3% wt may lead to the manifestation of undesirable effects on treated substrates, particularly carpet surfaces. Such undesirable effects include a notable decrease in the water repellent characteristics of such treated substrates, as well as a total loss in the water repellent characteristics as well. Thus, the amount of chelating agents in the compositions are to be critically evaluated with respect to such an effect. While not wishing to be bound by the following, it is nonetheless hypothesized that this behavior observed by the present inventors with respect to ethylenediaminetetraacetic acid salts as a chelating agent are believed to be equally applicable to other alkyl tetraaceticacid diamines and salts thereof.

With regard to a further optional constituent (e), a preservative ingredient, since a significant portion of the formulation comprises water, it is preferably that the preservative be water soluble. Such water soluble preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. An exemplary commercially available preservative comprising a mixture of 5-chloro-2-methyl-4-isothiazolin-3-one and 2-methyl-4-isothiazolino3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), SUTTOCIDE® A which is presently commercially available from Sutton Laboratories (Chatam, N.J.), TEXTAMER® 38AD which is presently commercially available from Calgon Corp. (Pittsburgh, Pa.) and preferably is PROXEL®

GXL which is presently commercially available from Zeneca Biocides (Wilmington, Del.) which is described as being 1,2-benzisothiazolin-3-ene (17% wt.) and inert ingredients (83% wt.). The preferred preservative has been observed to exhibit good compatability with the other constituents in accordance with preferred embodiments of the inventive compositions.

The compositions according to the invention optionally but desirably include an amount of a pH adjusting agent or pH buffer composition. Such compositions include many which are known to the art and which are conventionally used. By way of non-limiting example pH adjusting agents include phosphor containing compounds, monovalent and polyvalent salts such as of silicates, carbonates, and borates, certain acids and bases, tartarates and certain acetates. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Desirably the compositions according to the invention include an effective amounts of an organic acid and/or an inorganic salt form thereof which may be used to adjust and maintain the pH or the compositions of the invention to the desired pH range. Particularly useful is citric acid and sodium titrate which are widely available and which are effective in providing these pH adjustment and buffering effects.

Further useful optional constituents include optical brighteners are known optical brightening agents, including those based on stilbene derivatives and distyrylbiphenyl derivatives. Bleaching agents known to the art, including hydrogen peroxide may be used in the inventive compositions.

The compositions of the invention may optionally include one or more constituents which are intended to modify the visual appearance thereof, such as one or more coloring agents, such as dyes and/or pigments, as well as compositions which act as opacifiers. These are generally included in only minor amounts.

The compositions of the invention may also optionally include a fragrance compositions or other composition for modifying the scent characteristics of the inventive compositions. Such may be any of a number of known materials, including those known to be effective in absorbing odors, those known useful in masking odors, as well as those which are known to impart or provide a specific scent. Such fragrance compositions are generally included in only minor amounts.

Such constituents as described above as essential and/or optional constituents include known art compositions, include those described in *McCutcheon's Emulsifiers and Detergents* (Vol. 1), *McCutcheon's Functional Materials* (Vol. 2), North American Edition, 1991; *Kirk-Othmer, Encyclopedia of Chemical Technology*, 3rd Ed., Vol. 22, pp. 346–387, the contents of which are herein incorporated by reference.

As a further optional constituent (e) the inclusion of amounts of a further flurorosurfactant composition different than that recited as constituent (a) is contemplated. Such may be desired in order to improve certain characteristics of the present inventive compositions. Such a further fluorosurfactant composition may be added in amounts which facilitate the oil repellent, viz., the oleophobic characteristics of substrates treated with the compositions being taught herein.

One such exemplary further fluorosurfactant composition which is desirably included in the compositions of the invention is a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion, preferably lithium.

Another such exemplary further fluorosurfactant composition includes a perfluoroalkyl phosphate or salt thereof according to the formula (B):

$$CF_3—CF_2(CF_2CF_2)_n—CH_2CH_2—O—P(=O)(O^-)(O^-) \quad (B)$$

where:

n is an integer having a value of from 6 to 12.

These fluorosurfactant compositions according to formulae (A) and (B) may be used singly, or may be used in a mixture. When used as a mixture, desirably the weight ratio of the perfluoropropionate to the perfluoroalkyl phosphate is in the range of from about 1:1 to 1:2. Such a mixture is presently commercially available as ZONYL® 7950. Such fluorsurfactant compositions include those which are described in U.S. Pat. No. 5,439,610 to Ryan, et al., the contents of which are herein incorporated by reference.

Additional exemplary further fluorosurfactant compositions which are desirably included in the compositions of the invention include materials are presently commercially available under the tradename ZONYL® from E. I. DuPont de Nemours Co. Exemplary materials include ZONYL® FSA which is described as being $F(CF_2CF_2)_{3-8}CH_2CH_2SCH_2CH_2CO_2Li$; ZONYL® FSP which is described as being $(F(CF_2CF_2)_{3-8}CH_2CH_2O)P(O)(ONH_4)_2$; ZONYL® FSE which is described as being $(F(CF_2CF_2)_{3-8}CH_2CH_2O)_2P(O)(ONH_4)_2$; ZONYL® UR which is described as being $(F(CF_2CF_2)_{3-8}CH_2CH_2O)P(O)(OH)_2$ as well as $(F(CF_2CF_2)_{3-8}CH_2CH_2O)_2P(O)(OH)$; ZONYL® FSJ which is described as being $(F(CF_2CF_2)_{3-8}CH_2CH_2O)P(O)(ONH_4)_2$ in conjunction with a nonfluorinated surfactant; ZONYL® TBS which is described as being $F(CF_2CF_2)_{3-8}CH_2CH_2SO_3H$ as well as $F(CF_2CF_2)_{3-8}CH_2CH_2SO_3NH_4$. Each of these materials may be used jointly such as in a mixture of two or more flurorosurfactants, or singly. Of these materials, those available as ZONYL® 7950 are particularly preferred. The inventors have observed that nonionic fluorosurfactants provide little or no repellency.

One or more anti-resoiling compositions, also interchangeably referred to as resoiling inhibitors are also desirably included in the compositions of the invention. These anti-resoiling compositions include those known to the art to inhibit the resoiling of treated carpet fibers and carpet surfaces. Such compositions include compounds exhibiting an anti-resoiling effect for example, colloidal silica, aluminum oxides, styrene-maleic anhydride copolymer resins, polyvinylpyrrolidone, polyacrylates, polycarboxylates, modified cellulose polymers, vinyl acetate/maleic anhydride copolymer resins, cationic amines, aliphatic quarternary ammonium salts known to have anti-static properties, imidazoline salts as well as others known to the art. Such compounds which inhibit resoiling may be added in amounts of from 0–2% wt., but are desirably included in amounts of from 0.001% wt–1% wt.

Particularly preferred anti-resoiling compounds useful in the present inventive compositions are fluorinated acrylic polymers; the inclusion of such fluorinated acrylic polymers and salts in the compositions of the invention improve the resoiling resistance of fibrous substrates treated with said compositions. A specific and preferred fluorinated acrylate copolymer is one which conforms to the formula (C):

$$CF_3(CF_2)_nCH_2OCOC(CH_3)=CH_2 \quad (C)$$

wherein n represents a value of from 6–8.

This fluorinated acrylate copolymer may be generally characterized by a total fluorine content based on polymer solids of approximately 0.6 percent. This fluorinated acrylate copolymer may also may contain a zinc complex to act as a crosslinker. The number average (Mn) and weight average (Mw) molecular weights are generally in the range of approximately 9,000 and approximately 10,500 respectively. Such a fluorinated acrylate copolymer may be obtained commercially as a water based dispersion of approximately 76–77 weight % water; 18–19 weight % acrylate copolymer; 1 weight % nonylphenoxypolyethoxyethanol; 1 weight % sodium lauryl sulfate; and 1 weight % zinc oxide complex (with said weight % of the ingredients based on the total weight of the water dispersion), as SYNTRAN® 1575 (Interpolymer Corporation, Canton, Mass.). When this SYNTRAN® 1575 composition is employed as constituent (b), it may be included in the present inventive compositions in amounts such that the fluorinated acrylate copolymer is present from 0.001–2% wt., desirably in amounts of from 0.001% wt–0.75% wt., and most desirably in amounts of from 0.05% wt.–0.5% wt. with such recited weights being based on the weight of the fluorinated acrylic polymers and/or salts thereof present.

One further particularly anti-resoiling compound particularly useful in the present inventive compositions are a non-halogenated, especially a non-fluorinated, acrylic polymer compounds which may be represented by the formula (D):

$$(—CH_2—CH(COOR)—)_n \quad (D)$$

wherein n is a value greater than 50.

Such a non-fluorinated acrylic polymer is presently commercially available and may be obtained as an aqueous dispersion which includes 78–79% wt. water, 18–19% wt. of the non-fluorinated acrylic polymer, 1% wt. of sodium lauryl sulfate, 1% wt. sodium nonylpehnoxypolyethoxyethanol sulfate, and 1% wt. zinc oxide complex as SYNTRAN® 1580, as well as an aqueous dispersion which includes 74–75% wt. water, 23–24% wt. of the non-fluorinated acrylic polymer, 1% wt. of sodium monoalkylarylpolyethoxy sulfosuccinate, and 1% wt. sodium lauryl sulfate sulfate as SYNTRAN® 1588. These materials are considered to be infinitely miscible in water by the manufacturer, and the former is provided as an aqueous dispersion having a pH of 8.3 to 9.3, and the latter is provided as an aqueous dispersion having a pH of 7.7 to 8.7. Both of these materials may be obtained from Interpolymer Corporation (Canton, Mass.).

The non-fluorinated acrylic polymer may be included in the present inventive compositions in an amount of from 0.001–2% wt., but are desirably included in amounts of from 0.001% wt–0.75% wt., and most desirably are included in amounts of from 0.05% wt.–0.50% wt. with such recited weights being based on the weight of the non-fluorinated acrylic polymers and/or salts thereof present.

The compositions according to the invention also include minor amounts of one or more nonionic surfactants particularly alkoxylated aliphatic primary alcohols and alkoxylated aliphatic secondary alcohols. Such include for example $C_8$–$C_{20}$ primary or secondary aliphatic alcohols condensed with from 2–10 moles of one or more alkylene oxides. Such alkoxylated compounds specifically include ethylene oxide, propylene oxide and butylene oxides, of which ethylene oxide, propylene oxide, or mixtures thereof are preferred, and further of which condensates containing only ethylene oxide as the alkoxyl moiety is most preferred.

Desirably the nonionic surfactant constituent, when present, is selected from alkoxylated $C_8$–$C_{15}$ primary aliphatic alcohols, and an alkoxylated $C_{10}$–$C_{15}$ secondary aliphatic alcohol in which ethylene oxide and/or propylene oxide represents the alkoxylate moiety of such surfactants.

Illustrative examples of these preferred water soluble nonionic ethoxylated phenols and/or ethoxylated alcohols surfactants include one or more of those available under the tradename of NEODOL®, presently commercially available from the Shell Oil Company; TERGITOL®, presently commercially available from Union Carbide, and POLYTERGENT®, presently commercially available from the Olin Chemical Co., IGEPAL® presently commercially available from the Rhône-Poulenc Co., as well as ethoxylated/propoxylated primary alcohols sold under the tradename PLURAFACS® and available from BASF Inc. Particular examples of such include NEODOL® 91-6 which is described as being a $C_9$–$C_{11}$ linear primary alcohol which includes 6 ethoxy groups per molecule, as well as TERGITOL® 15-S-9 which is described as being a $C_{11}$–$C_{15}$ secondary alcohol which includes 9 ethoxy groups per molecule. Further examples include POLYTERGENT® SL-62 which is described as being an alkoxylated linear aliphatic $C_8$–$C_{10}$ alcohol having a number of both ethoxy and propoxy groups per molecule, POLYTERGENT® SL-22 which is described as being an alkoxylated linear aliphatic $C_8$–$C_{10}$ alcohol having a number of both ethoxy and propoxy groups per molecule groups per molecule, as well as PLURAFACS® C-17 which is described as being a $C_{10}$–$C_{12}$ alkoxylated fatty alcohol. A particularly useful alkoxylated linear alcohol POLYTERGENT® SL-55 which is described as being a mixture of alkoxylated linear $C_8$–$C_{10}$ aliphatic alcohols.

Other known nonionic surfactant compounds are contemplated as being useful in the compositions according to the present invention and these include alkoxylated alkyl aromatic compounds. Such compounds contain at least one aromatic moiety, such as a phenol, as well as an alkyl chain which may be straight chained or branched. Desirably the aromatic moiety is $C_5$–$C_7$, and particularly $C_6$ aromatic moieties are preferred, and wherein the alkyl chain is a $C_8$–$C_{20}$ alkyl group. The alkoxyl groups in such may be ethylene oxide, propylene oxide and butylene oxides, of which ethylene oxide, propylene oxide, or mixtures thereof are preferred, and further of which ethylene oxide is most preferred.

Such alkoxylated alkyl aromatic compounds are per se known to the art and are presently commercially available from a variety of sources including those sold under the tradename IGEPAL® and available from ISP Corporation (Wayne, N.J.) and TRITON® and available from Union Carbide Corp. (Danbury Conn.). Particular examples of such include IGEPAL® CO-630 which is described as being a nonyl phenol ethoxylate, TRITON® X-100 described as being an isooctyl phenol ethoxylate and particularly IGEPAL® CA-210 described as being a $C_{10}$–$C_{12}$ ethoxylated octyl phenol with an average of 1.5 ethoxy groups per molecule.

The nonionic surfactant compositions desirably exhibit an HLB number in the range of from 4 to 20 and most desirably in the range of from 6 to 15.

The nonionic surfactants are present in amounts of from 0% wt. to 0.5% wt., such recited weights being based on the weight of the actives in the nonionic surfactant composition. Particular care should be taken in determining whether the inclusion of such nonionic surfactants are necessary or desirable; the inventors have observed that excessive amounts may give rise to an undesired reduction in the water and oil repellency characteristics imparted by the cleaning compositions of the invention.

In a preferred embodiment of the invention there is provided an aqueous pourable and pumpable cleaning and treatment composition, preferably a carpet cleaning and treatment composition which comprises, (per 100% weight of the composition), but preferably consists essentially of the following constituents:

(a) 0.001–0.5% wt. of afluoroaliphatic radical-containing poly(oxyalkylene) compound;

0.001–1% wt. anti-resoiling compound;

(b) anionic surfactant selected from alkyl sulfates, alkyl benzene sulfates, alkane sulfonates wherein anionic surfactant is present in the ratio of 1.5 to 6 parts by weight anionic surfactant per 1 part by weight of the fluoroaliphatic radical-containing poly(oxyalkylene) compound and;

(c) 0.001–8% wt. of an organic solvent selected from glycols, glycol ethers, ether acetates, acetates and $C_3$–$C_8$ alcohols;

(d) at least 80% wt. water (e) 0–1.999% wt. of one or more optional additives selected from preservatives, coloring agents such as dyes and pigments, fragrances, anti-foaming agents, pH adjusting agents, buffer compositions, further fluorosurfactants, one or more nonionic surfactants especially those selected from alkoxylated primary alcohols and alkoxylated secondary alcohols, chelating agents, optical brighteners, polymers especially those useful as anti-resoiling agents, and further solvents.

It is to be understood that although the aqueous cleaning compositions taught herein have been generally discussed in conjunction with the cleaning of carpets and carpet fibers, it is nonetheless to be understood that they may be utilized in the cleaning of a wide variety of fibers and fibrous substrates including but not limited to those which comprise fibers which are made of naturally occurring or synthetically produced materials, as well as blends or mixtures of such materials. Substrates which can be treated in accordance with this invention are textile fibers or filaments, either prior to their use, or as used in fabricated fibrous articles such as fabrics and textiles, rugs, carpets, mats, screens, and the like. Articles produced from such textiles, such as garments and other articles of apparel such as scarves, gloves and the like may also be treated. Further, sporting goods such as hiking and camping equipment made from or with a fabric or textile may also be treated with the cleaning compositions being taught herein in order to clean and/or impart a degree of water and oil repellency thereto. The textiles and fabrics include those made with or of one or more naturally occurring fibers, such as cotton and wool, regenerated natural fibers including regenerated cellulose, and those made with or of synthetically produced fibers, such as polyamides, polyolefins, polyvinylidene chlorides, acetate, nylons, polyacrylics, rayon, and polyester fibers. Blends of two or more such fibrous materials are also expressly contemplated. Such textiles and fabrics may be woven, non-woven or knitted materials.

The compositions of the invention may also be used in conjunction with wood, paper, paperboard and leather substrates.

The compositions of the invention can be prepared in a conventional manner such as by simply mixing the constituents in order to form the ultimate aqueous cleaning composition. The order of addition is not critical. Desirably, and from all practicable purposes, it is advantageous that the constituents other than water be added to a proportion of the total amount of water then well mixed, and most desirably that the surfactants be first added to the volume of water, followed by any remaining ingredients especially the optional constituents, and that the fluorochemical be added last to ensure the best phase stability. Subsequently any remaining balance of water, if any should be required, is then added. Optionally, the pH adjusting agents and/or pH buffering compositions be added in a sufficient amount in order to bring the formed composition within the pH range desired following the final addition of any remaining balance of water, but they may also be added at any other step including in an addition step preceding the addition of the fluorochemical.

The compositions according to the invention may be conveniently applied to a substrate in any of a, variety of conventional fashions, such as by spraying, dipping, coating, padding, foam or roller application, or by a combination of one or more of these, or with other methods not noted here but known to the art. The compositions according to the invention are used in a conventional manner in the cleaning of carpet surfaces. Generally, carpets are effectively cleaned by spraying about 5 grams per square foot of the carpeted surface with the aqueous cleaning composition and subsequently allowing said composition to penetrate amongst the carpet surface and the fibers. Desirably, this is further facilitated by the use of a manual agitation action, such as by rubbing an area of the carpet to be treated with a device such as a brush, sponge, mop, cloth, non-woven cloth, and the like until the aqueous cleaning composition is well intermixed amongst the carpet fibers. Where a carpet has an open pile, less manual agitation is usually required as opposed to carpets having closed loop piles wherein longer agitation and/or more vigorous agitation is generally required. This agitation may be repeated optionally by periodically rinsing the device in water and then reagitating and/or optionally reapplying an amount of the aqueous cleaning composition of the invention. This may continue until by visual inspection the soil is removed from the carpet surface to the cleaning device. Subsequently, the treated area is permitted to dry, which usually requires from as little as 5–10 minutes in areas of high heat and low humidity to as much as an hour or more in poorly heated and high humid locations. Generally, however, the drying period under typical conditions is between about 15 minutes to about 30 minutes. Optionally, but desirably, any remaining cleaning composition may be removed from the carpet such as by vacuuming in a conventional manner. In a further optional technique, the carpet may be brushed so to remove any residue of the aqueous cleaning composition from amongst the carpet fibers, and then vacuumed or brushed out from the carpeted area.

In contrast to many of the compositions known in the prior art, the aqueous cleaning compositions according to the present inventions surprisingly provide good cleaning efficacy, and simultaneously provide and/or restore to the treated carpet surface a degree of water and oil repellency, which are important in limiting the resoiling of the treated carpet surface. As had been noted previously, many known prior art compositions provide no restoration of either water or oil repellency to treated carpet surfaces, but are generally considered merely as cleaners, yet others may have imparting degree of water or oil repellency to a carpet surface, but not necessarily have provided any efficacious cleaning benefit. Thus, the compositions of the present invention provide these three simultaneous characteristics which are critical in maintaining the attractive appearance of carpeted surfaces, as well as concomitantly extending their useful service life.

The following examples illustrate the superior properties of the formulations of the invention and particular preferred embodiments of the inventive compositions. The terms "parts by weight" or "percentage weight" are used interchangeably in the specification and in the following Examples wherein the weight percentages of each of the individual constituents are indicated in weight percent based on the total weight of the composition, unless indicated otherwise.

EXAMPLES

The following examples illustrate the superior properties of the formulations of the invention and particular preferred embodiments of the inventive compositions. Exemplary formulations illustrated on Table 1 indicate the weight percentages of each of the individual constituents are indicated based on the total weight of the composition of which it forms a part.

The example formulations described in more particular detail on Table 1 below were prepared in accordance with the following general protocol. To a mixing vessel (glass beaker equipped with a magentic stirrer) was first provided a part of the total amount of water, the agitator was then energized, and to the water was then added the remaining constituents. The order of the addition of the remaining constituents varied from formulation to formulation as the order of addition is not critical, but the addition of surface active agents first to the water is generally to be preferred as aiding in the dissolution/dispersion of the remaining constituents. The contents of the mixing vessel were well mixed, and ultimately the remaining balance of water, if any was required, was then added.

These example formulations were used "as is", that is to say without further dilution in the subsequent testing protocols.

TABLE 1

FORMULATIONS

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 |
|---|---|---|---|---|---|---|---|---|---|---|---|---|---|---|
| fluorosurfactant (27% wt.) | 0.65 | 0.6 | 0.6 | 0.75 | 0.9 | 1 | 0.6 | 1.25 | 1.25 | 1 | 1.25 | 0.75 | 0.75 | 0.75 |
| fluorinated acrylic copolymer (20% wt.) | 0.4 | 0.4 | 0.4 | 0.4 | 0.4 | 0.4 | 0.4 | 0.4 | 0.4 | 0.2 | 0.4 | 0 | 0 | 0 |
| sodium lauryl sulfate (30% wt.) | 2.62 | 2.37 | 2.37 | 2.62 | 2.62 | 2.62 | 3.17 | 1.6 | 3.17 | 3.5 | 3.5 | 1.00 | 3.00 | 5.00 |
| sodium alkane sulfonate (30% wt.) | 0 | 0.25 | 0.25 | 0 | 0 | 0 | 0.33 | 0.25 | 0.33 | 0 | 0 | 0 | 0 | 0 |
| alkoxytated alcohol | 0 | 0 | 0 | 0 | 0 | 0 | 0 | 0 | 0 | 0 | 0.18 | 0 | 0 | 0 |
| ethylene glycol hexyl ether | 1.5 | 1.25 | 1.25 | 1.25 | 1.15 | 1 | 1.25 | 0 | 1.25 | 1.25 | 1.25 | 1.00 | 1.00 | 1.00 |
| diethylene glycol hexyl ether | 0.3 | 0.5 | 0 | 1 | 0.75 | 0.75 | 0 | 0 | 0 | 0 | 0 | 0 | 0 | 0 |
| diethylene glycol methyl ether | 0 | 0 | 0 | 0 | 0 | 0 | 0 | 6 | 0 | 0 | 0 | 0 | 0 | 0 |
| 1-pentanol | 0 | 0 | 0.2 | 0 | 0 | 0 | 0 | 0 | 0 | 0 | 0 | 0 | 0 | 0 |
| isopropanol | 0 | 0 | 0 | 0 | 0 | 0 | 2 | 1.75 | 2 | 2 | 2 | 0 | 0 | 0 |
| fragrance | 0.2 | 0.2 | 0.2 | 0.2 | 0.2 | 0.2 | 0.2 | 0.2 | 0.2 | 0.2 | 0.2 | 0 | 0 | 0 |
| tetrasodium EDTA (38% wt.) | 0.25 | 0.25 | 0.25 | 0.25 | 0.25 | 0.25 | 0.25 | 0.25 | 0.25 | 0.25 | 0.25 | 0.25 | 0.25 | 0.25 |
| citric acid, anhydrous | 0.01 | 0.01 | 0.01 | 0.01 | 0.01 | 0.01 | 0.01 | 0.01 | 0.01 | 0.01 | 0.01 | 0 | 0 | 0 |
| sodium citrate, anhydrous | 0.09 | 0.09 | 0.1 | 0.09 | 0.1 | 0.1 | 0.1 | 0.1 | 0.1 | 0.1 | 0.1 | 0.09 | 0.09 | 0.09 |
| preservative | 0.05 | 0.05 | 0.05 | 0.05 | 0.05 | 0.05 | 0.05 | 0.05 | 0.05 | 0.05 | 0.05 | 0.05 | 0.05 | 0.05 |
| d.i. water | 93.93 | 94.01 | 94.18 | 93.38 | 93.57 | 93.62 | 91.64 | 83.5 | 90.99 | 91.49 | 91.25 | 96.85 | 94.85 | 92.85 |

Table 1 illustrates the actual weight of the constituent added to form a respective exemplary formulation. The identity of the constituents used to form the example formulations, and (where relevant) the weight percent of the actives in a respective constituent, are specifically identified on Table 2 following.

TABLE 2

CONSTITUENTS

| | |
|---|---|
| fluorosurfactant (27% wt.) | proprietary composition, Fluorad ® FC-138 (27% wt. actives) |
| fluorinated acrylic copolymer (20% wt.) | Syntran ® 1575 (20% wt. actives), fluorinated acrylic polymer |
| sodium lauryl sulfate (30% wt.) | anionic surfactant, Rhodapon ® LCP (30% wt. actives), anionic surfactant |
| sodium alkane sulfonate (30% wt.) | Hostapur ® SAS (30% wt. actives) |
| alkoxylated alcohol | Poly Tergent ® SL-55 (100% wt. actives) |
| ethylene glycol hexyl ether | Hexyl Cellosolve ®, organic solvent |
| diethylene glycol hexyl ether | Hexyl Carbitol ®, organic solvent |
| diethylene glycol methyl ether | Methyl Carbitol ®, organic solvent |
| 1-pentanol | 1-pentanol |
| isopropanol | isopropanol |
| fragrance | proprietary composition |
| tetrasodium EDTA (38% wt.) | tetrasodiumethylenediaminetetraacetic acid (38% wt. actives), as pH adjusting agent |
| citric acid, anhydrous | citric acid, anhydrous |
| sodium citrate, anhydrous | sodium citrate, anhydrous |
| preservative | Kathon ® CG/ICP, proprietary composition |
| d.i. water | deionized water |

Certain characteristics of the formulations according to Examples 1–11 were evaluated in accordance with one or more of the following test protocols.

Cleaning—Protocol 1

The cleaning characteristics of compositions according to the invention were evaluated in accordance with the following general protocol. A carpet swatch approximately 5 inches by 5 inches made of a light beige colored, standard medium cut pile nylon carpeting formed the standard testing substrate. Such carpet swatches are similar to those presently commercially available as DuPont® Stainmaster® carpets from a variety of commercial sources. Two test stains composed of 0.5 gram amounts of used automotive motor oil were applied to a carpet swatch by the use of a spatula to form satins having an area of approximately 1 inch square. The motor oil was allowed to settle into the carpet undisturbed for a period of 30 minutes, after which a folded paper towel was used as a blotter which was lightly applied to the carpet surface so to withdraw any remaining surface oil.

Immediately thereafter, a sample of a cleaning composition, either a formulation recited on Table 1 according to the invention or a control formulation in accordance with formula 25-060B of U.S. Pat. No. 5,439,610 was applied to one of the test stains. The formulations of Table 1 were supplied to the other test stain on a carpet swatch. Both formulations were supplied using a dispensing bottle supplied with a manually pumpable trigger spray apparatus, and approximately equal amounts of a both formulations, 6–8 grams, were thus applied to the test stains of the carpet swatches. After this application, the formulations were permitted to lie undisturbed for three minutes in order to permit the applied formulation to penetrate the carpet surface and the carpet fibers. Subsequently the treated stain was rubbed lightly using a folded over and water moistened paper towel or a similarly moistened wash cloth by applying 50 strokes at the site of the stain. These cycles or strokes were applied manually and care was taken to both stay within the borders of the stained area where possible, and to maintain a uniform pressure across all of the stained samples. Subsequently, the folded over paper towel was discarded and the so treated carpet swatch was allowed to dry and rest undisturbed overnight. Such a treatment protocol replicated in actual consumer in-use mode of application.

This testing protocol was repeated for each of the formulations on Table 1, which was compared in a side-by-side manner with the control formulation.

Evaluation of the cleaning efficacy of a composition according to the invention versus the control composition was visually observed and evaluated on the following day. The results of the cleaning testing are reported on Table 3-1.

TABLE 3-1

| CLEANING .VS. CONTROL FORMULATION | |
|---|---|
| Ex. 1 | better |
| Ex. 2 | better |
| Ex. 3 | better |
| Ex. 4 | parity |
| Ex. 5 | better |
| Ex. 6 | parity |
| Ex. 7 | parity/worse |
| Ex. 8 | worse |
| Ex. 9 | parity/worse |
| Ex. 10 | worse |
| Ex. 11 | parity/worse |

Following the visual inspection and as reported on Table 3-1, various formulations according to the Examples exhibited superior cleaning characteristics when compared to the control formulation, several were judged to have equivalent cleaning efficacy and were rated as "parity", several were judged to be slightly worse than the control formulation, and two were determined to be worse cleaners than the control formulation. It is to be understood however that none of the formulations of Ex. 1–11 were unsuitable for use as a cleaning composition as the reported results are on a relative scale and are compared to a popular commercially available product regarded to have excellent cleaning benefits.

Cleaning—Protocol 2

The cleaning characteristics of compositions according to Examples 12–14 were performed on identical carpet swatches and under the same general protocols as those used in Cleaning—Protocol 1 described above except that each carpet swatch was stained using motor oil and afterwards treated with amounts of each of the compositions according to Examples 12–14 as described previously, and further was again recleaned at the locus of the stain 3–4 hours later. In this protocol, the each of the test stains was cleaned twice, and also no side-by-side evaluations against a comparative cleaning composition was performed but each treated carpet swatch was individually evaluated.

At the conclusion of the treatment of the stained carpet swatches with the compositions according to Examples 12–14 ten panelists were asked to judge their impression of the cleaning efficacy of each composition and rate them on a scale of "0%" which was established as the appearance of an untreated motor oil stain which was blotted onto the carpet surface but not cleaned, to "100%" which was established to be the appearance of the unstained and untreated carpet swatch. Also, as a basis for comparison ("Control") a sample carpet swatch was stained and subsequently treated in the manner generally described above utilizing a composition in accordance with formula 25-060B of U.S. Pat. No. 5,439,610. This stained and treated sample was likewise evaluated by the panelists. The averages of the results of this panel rating test is reported on Table 3-2, below as "Panel Rating; % cleaning".

Afterwards, each of the swatches evaluated by the panelists were evaluated for reflectance using a Minolta Chromameter in order to determine the change in reflectance between a stained carpet swatch before its treatment with a composition versus the stained and subsequently treated carpet swatch. Again for comparative purposes a sample carpet swatch was stained and subsequently treated in the manner generally described above utilizing a composition in accordance with formula 25-060B of U.S. Pat. No. 5,439,610 as a "Control" composition This stained and treated sample was likewise evaluated. These results are reported on Table 3-2, below as "Chromameter Rating; % cleaning".

TABLE 3-2

| CLEANING .VS. CONTROL FORMULATION | Panel Rating; % cleaning | Chromameter Rating; % cleaning |
|---|---|---|
| Example 12 | 73.5 | 76.7 |
| Example 13 | 90.9 | 82.3 |
| Example 14 | 96.6 | 85.9 |
| Control | 93.1 | 81.9 |

As can be seen from the results, excellent cleaning characteristics comparable to, or better than known art compositions are provided.

Oil repellency

Oil repellency characteristics of sample carpet swatches were evaluated generally in accordance with the following protocol. For this test, carpet swatches approximately 5 inches by 5 inches made of a light beige colored level loop nylon carpeting formed the standard testing substrate. Such carpet swatches are similar to those presently commercially available as DuPont® Stainmaster® carpets from a variety of commercial source, but differed from those commercially available as well as those described previously as they were produced without any fluorochemical fiber or surface treatments directed to provide water and/or oil repellency to the carpet fibers.

In the performance of the oil repellency testing, standardized oil compositions were utilized which are identified as follows the following: Oil #1 was a composition consisting solely of mineral oil; Oil #2 was a composition comprising 65 parts by weight mineral oil and 35 parts by weight hexadecane; Oil #3 consisted essentially of hexadecane; Oil #4 consisted essentially of tetradecane; and the last standardized Oil #5 consisted essentially of dodecane.

Clean, light beige colored sample carpet swatches of the same size and type as those used in the cleaning evaluations denoted above were treated with one of the formulations recited on Table 1. In the performance of the test a 15–20 gram amount of a single formulation was dispensed to the surface of the carpet swatch with the use of a manually pumpable trigger spray dispenser and thereafter rubbed into and amongst the carpet fibers for 30 seconds, in a manner to adequately cover the entire surface of the sample carpet swatch. The treated carpet swatch was then permitted to dry at ambient temperature (room temperature, approx. 20° C.) for 24–48 hours at a relative humidity in the range of 20–55%.

Subsequently, the standardized oils were used in rising numerical sequence in order to evaluate the oil repellent characteristics imparted to the treated carpet swatches. Beginning with Oil #1, a drop of said oil was placed upon the surface of the carpet fiber and it was observed carefully. If the oil droplet maintained a bead on the carpet surface for 30 seconds, this treated carpet swatch was judged to have a rating of at least "1". The protocol was repeated in a different part of the carpet utilizing the next numerically higher oil number, in this case, Oil #2. Again, if the oil droplet maintained a bead on the carpet surface for 30 seconds, this treated carpet swatch was judged to have a rating of at least "2". This protocol was repeated using in sequence standardized oils #3, #4 and #5 until a standardized oil failed to maintain its bead upon the surface of the carpet for the 30 second period noted above. If the bead of a particular standardized oil was observed to be partially but not totally absorbed by the carpet swatch, or to slump in its appearance during the 30 second interval, then a value of "0.5" was added to the prior number of the standardized oil which maintained a droplet bead on the carpet surface for 30 seconds, and this number was reported. Otherwise, the highest numbered standardized oil which did maintain its bead upon the surface during the 30 second interval was reported on Table 4 following.

This testing protocol was repeated for each of the formulations on Table 1

Water repellency

Water repellency characteristics of sample carpet swatches were evaluated generally in accordance with the following protocol.

In the performance of the water repellency characteristics, standardized water compositions were utilized which may be generally characterized as the following: the standardized water #1 was a sample comprising deionized water and 2% weight isopropyl alcohol; standardized water #2 was deionized water comprising 5% isopropyl alcohol; standardized water #3 consisted of deionized water comprising 10% by weight isopropyl alcohol; standardized water #4 consisted essentially of deionized water with 20% by weight isopropyl alcohol; and standardized water #5 comprised 30% by weight isopropyl alcohol with deionized water.

Clean, light beige colored sample carpet swatches of the same size and type as those used in the and oil repellency evaluations as described above were treated with one of the formulations recited on Table 1. In the performance of the test a 15–20 gram amount of a single formulation was dispensed to the surface of the carpet swatch with the use of a manually pumpable trigger spray dispenser and thereafter rubbed into and amongst the carpet fibers for 30 seconds, in a manner to adequately cover the entire surface of the sample carpet swatch.

Subsequently, the standardized water samples were used in rising numerical sequence in order to evaluate the water repellent characteristics imparted to the treated carpet swatches. Generally, and beginning with standardized water #1, a drop of said water was placed upon the surface of the carpet fiber and it was observed carefully. If the water droplet maintained a bead on the carpet surface for 10 seconds, this treated carpet swatch was judged to have a rating of at least "1". The protocol was repeated in a different part of the carpet utilizing the next numerically higher water number, in this case, standardized water #2. Again, if the water droplet maintained a bead on the carpet surface for 10 seconds, this treated carpet swatch was judged to have a rating of at least "2". This protocol was repeated using in sequence standardized waters #3, #4 and #5 until a standardized water failed to maintain its bead upon the surface of the carpet for the 10 second period noted above. If the bead of a particular standardized water was observed to be partially but not totally absorbed by the carpet swatch, or to slump in its appearance during the 10 second interval, then a value of "0.5" was added to the prior number of the standardized water which maintained a droplet bead on the carpet surface for 10 seconds, and this number was reported. Otherwise, the highest numbered standardized water which maintained its bead upon the surface during the 10 second interval was reported on Table 4 following.

This testing protocol was repeated for each of the formulations on Table 1

TABLE 4

| | REPELLENCY | |
|---|---|---|
| | Oil | Water |
| Ex. 1 | 2 | 1.5 |
| Ex. 2 | 2.5 | 1 |
| Ex. 3 | 2 | 3 |
| Ex. 4 | — | — |
| Ex. 5 | — | 0 |
| Ex. 6 | 2.5 | 2.5 |
| Ex. 7 | 2.5 | 1.5 |
| Ex. 8 | 2.5 | 2.5 |
| Ex. 9 | 2.5 | 2.5 |
| Ex. 10 | 3 | 3 |
| Ex. 11 | 2 | 3 |
| Ex. 12 | 3 | 3 |
| Ex. 13 | 3 | 1.5 |
| Ex. 14 | 1.5 | 0 |

"—" indicates that the sample was not tested

As may be seen from the results indicated on Table 4, various of the formulations of Table 1, representative of compositions according to the invention, simultaneously imparted excellent water repellency and oil repellency characteristics to the treated carpet fibers and carpet surfaces. Such results are particularly significant further in conjunction with the cleaning efficacy results which are reported on Table 3 above which demonstrate that excellent cleaning benefits are also simultaneous provided in conjunction with the water and oil repellency characteristics. It is also to be noted that certain of the formulations, especially those according to Examples 13 and 14 exhibited a decrease in water repellency which may be attributed to the relatively higher levels of anionic surfactants. At the same time however, it is to be noted that oil repellency was not necessarily unacceptably affected.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. Aqueous cleaning compositions which impart oil and water repellent characteristics to fibrous substrates which comprise:

(a) a fluoroaliphatic oligomer or polymer according to the general formulae (3):

$$C_aF_{2a+a}N(CH_3)(W)_3(A)_nB^{31'}X^+ \quad (3)$$

in which:

B is a water soluble group selected for sulfate, sulfonate, carboxylate, phosphate, phosphonate or halogen group;

W is a lower alkyl group especially a $—CH_2—$, $—CH_2CH_2—$ and/or $—CH_2CH_2CH_2—$;

A is an ethoxy ($OC_2H_4$), propoxy ($OC_3H_6$), and/or butoxy ($OC_4H_8$) or is a mixture of two or more such groups;

X+ is a salt forming organic counterion, or an inorganic counterion;

n represents a value of between 1 and 8;

a represents a value of between 1 and 12, (b) anionic surfactant selected from alkyl sulfates, alkyl benzene sulfates, and alkane sulfonates as well as salt forms thereof;

(c) organic solvent;

(d) water;

and further optionally;

(e) one or more additives selected from preservatives, coloring agents; fragrances, anti-foaming agents, pH adjusting agents, buffer compositions, anti-soiling agents and resoiling inhibitors, chelating agents, optical brighteners, further solvents or surfactants, one or more further fluorosurfactant compositions, and one or more nonionic surfactants selected from alkoxylated primary alcohols and alkoxylated secondary alcohols as well as salt forms thereof.

2. The aqueous cleaning composition according to claim 1 wherein the fluoroaliphatic radical-containing poly (oxyalkylene) compound is a fluoroaliphatic oligomer or polymer according to the general formulae (3) in which:

A represents an ethoxy ($OC_2H_4$), propoxy ($OC_3H_6$), and/or a mixture of such groups.

3. The aqueous cleaning composition according to claim 2 wherein the fluoroaliphatic radical-containing poly (oxyalkylene) compound is a fluoroaliphatic oligomer or polymer according to the general formulae (3) in which:

X+ is a salt forming inorganic counterion.

4. The aqueous cleaning composition according to claim 2 wherein the fluoroaliphatic radical-containing poly (oxyalkylene) compound is a fluoroaliphatic oligomer or polymer according to the general formulae (3) in which:

n represents a value of from 1 to 5 inclusive.

5. The aqueous cleaning composition according to claim 2 wherein the fluoroaliphatic radical-containing poly (oxyalkylene) compound is a fluoroaliphatic oligomer or polymer according to the general formulae (3) in which:

a represents a value of between 5 to 12 inclusive.

6. The aqueous cleaning composition according to claim 2 wherein the fluoroaliphatic radical-containing poly (oxyalkylene) compound is a fluoroaliphatic oligomer or polymer according to the general formulae (3) in which:

X+ is a salt forming alkali or alkaline earth metal counterion.

7. The aqueous cleaning composition according to claim 1 wherein:

the fluoroaliphatic radical-containing poly(oxyalkylene) compound is a fluoroaliphatic oligomer or polymer according to the general formulae (4):

$$C_8F_{17}N(CH_3)(CH_2)_3(A)_nOSO_2^- X^+ \quad (4)$$

in which:

n represents a value of between 1 and 3, preferably is a value of from 1 to 2 inclusive, and most preferably is a value of about 1.5;

A represents an ethoxy ($OC_2H_4$), propoxy ($OC_3H_6$), or a mixture of such groups, but preferably represents ethoxy;

$X^+$ is a salt forming counterion such as an alkali or alkaline earth metal counterion.

8. The aqueous cleaning composition according to claim 7 wherein:

the fluoroaliphatic radical-containing poly(oxyalkylene) compound is a fluoroaliphatic oligomer or polymer according to the general formulae (4):

in which:

n represents a value of from 1 to 2 inclusive.

9. The aqueous cleaning composition according to claim 7 wherein:

the fluoroaliphatic radical-containing poly(oxyalkylene) compound is a fluoroaliphatic oligomer or polymer according to the general formulae (4):

in which:

A represents ethoxy ($OC_2H_4$).

10. The aqueous cleaning composition according to claim 7 wherein:

the fluoroaliphatic radical-containing poly(oxyalkylene) compound is a fluoroaliphatic oligomer or polymer according to the general formulae (4):

in which:

$X^+$ is a salt forming alkali or alkaline earth metal counterion.

11. The aqueous cleaning composition according to claim 1 wherein:

the fluoroaliphatic radical-containing poly(oxyalkylene) compound is present in an amount of from 0.001% wt. to about 3% wt. based on the total weight of the composition.

12. The aqueous cleaning composition according to claim 11 wherein:

the fluoroaliphatic radical-containing poly(oxyalkylene) compound is present in an amount of from 0.1% wt. and 0.5% wt. based on the total weight of the composition.

13. An aqueous cleaning composition according to claim 1 wherein:

the anionic surfactant is an alkyl sulfate or salt form thereof.

14. An aqueous cleaning composition according to claim 1 wherein:

the anionic surfactant is an alkyl benzene sulfate or salt form thereof.

15. An aqueous cleaning composition according to claim 1 wherein:

the anionic surfactant is an alkane sulfonate or salt form thereof.

16. An aqueous cleaning composition according to claim 1 wherein:
the anionic surfactant is present in an amount of from 0.001% wt. to 2% wt.

17. An aqueous cleaning composition according to claim 1 wherein:
the anionic surfactant is present in an amount of from 0.25% wt. to 1.5% wt.

18. An aqueous cleaning composition according to claim 1 wherein:
weight ratios of the anionic surfactant to fluoroaliphatic radical-containing poly(oxyalkylene) compound is from 1.5–6 to 1.

19. An aqueous cleaning composition according to claim 1 wherein:
the organic solvent is one or more selected from: alcohols, glycols, acetates, ether acetates and glycol ethers.

20. An aqueous cleaning composition according to claim 19 wherein:
the organic solvent is selected from glycol ethers according to the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units.

21. An aqueous cleaning composition according to claim 19 wherein:
the organic solvent is a mixture of two different glycol ethers.

22. An aqueous cleaning composition according to claim 21 wherein:
the organic solvent is a mixture of 1 part of ethylene glycol hexyl ether to 0.1–1 parts diethylene glycol hexyl ether.

23. An aqueous cleaning composition according to claim 19 wherein:
the organic solvent is present in an amount of from 0.001% wt. to 8% wt.

24. An aqueous cleaning composition according to claim 1 wherein the pH of said composition is from 8 to 10.

25. An aqeuous cleaning composition according to claim 24 wherein the pH of said composition is from 8.4 to 9.1.

26. An aqueous cleaning composition according to claim 1 which further includes:
a further fluorosurfactant composition.

27. An aqueous cleaning composition according to claim 26 wherein the further fluorosurfactant composition is a perfluoropropionate according to the formula:

$$F(CH_2)_n—CH_2CH_2—S—CH_2CH_2—COO^-X^+ \quad (A)$$

where:

n is an integer having a value of 6 to 12; and, $X^+$ is a salt forming counterion.

28. An aqueous cleaning composition according to claim 26 wherein the further fluorosurfactant composition is a perfluoroalkyl phosphate or salt thereof according to the formula (B):

$$CF_3—CF_2(CF_2CF_2)_n—CH_2CH_2—O—P(=O)(O^-)_2 \quad (B)$$

where:

n is an integer having a value of from 6 to 12.

29. An aqueous cleaning composition according to claim 26 which comprises a mixture of a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion, with
a perfluoroalkyl phosphate or salt thereof according to the formula (B):

$$CF_3—CF_2(CF_2CF_2)_n—CH_2CH_2—O—P(=O)(O^-)_2 \quad (B)$$

where:

n is an integer having a value of from 6 to 12.

30. An aqueous cleaning composition according to claim 1 which further includes:
an anti-soiling agents or resoiling inhibitors.

31. An aqueous cleaning composition according to claim 30 which further includes:
an anti-resoiling compound selected from: colloidal silica, aluminum oxides, styrene-maleic anhydride copolymer resins, polyvinylpyrrolidone, polyacrylates, polycarboxylates, modified cellulose polymers, vinyl acetate/maleic anhydride copolymer resins, cationic amines, aliphatic quarternary ammonium salts known to have anti-static properties, and imidazoline salts.

32. An aqueous cleaning composition according to claim 30 which further includes as an anti-resoiling compound a fluorinated acrylate copolymer is one which conforms to the formula (C):

$$CF_3(CF_2)_nCH_2OCOC(CH_3)=CH_2 \quad (C)$$

wherein n represents a value of from 6–8.

33. An aqueous cleaning composition according to claim 30 which further includes as an anti-resoiling compound a fluorinated acrylate copolymer which conforms to the formula (D):

$$(—CH_2—CH(COOR)—)_n \quad (D)$$

wherein n is a value greater than 50.

34. An aqueous cleaning composition according to claim 1 which further includes:
a nonionic alkoxylated primary alcohol surfactant.

35. An aqueous cleaning composition according to claim 1 which further includes:
a nonionic alkoxylated secondary alcohol surfactant.

36. A process for simultaneously cleaning and providing water and oil repellency to a fiber or fibrous substrate which comprises the step of:
treating said fiber or fibrous substrate with a composition according to claim 1.

37. A process for simultaneously cleaning and providing water and oil repellency to a carpet fiber or carpet surface which comprises the step of:
treating said carpet fiber or carpet surface with a composition according to claim 1.

* * * * *

UNITED STATES PATENT AND TRADEMARK OFFICE

CERTIFICATE OF CORRECTION

PATENT NO. : 5,712,240

DATED : 27 January 1998

INVENTOR(S) : Michael Richard TYERECH; Jeanne Marie WELLER; Andrew Francis COLURCIELLO and Tracy Ann RYAN It is certified that error appears in the above-identified patent and that said Letters Patent is hereby corrected as shown below:

Column 23, line 20, please delete $$"C_aF_{2a+a}N(CH_3)(W)_3(A)_nB^{31'}X^+ \qquad (3)"$$

and insert the following:

$$--C_aF_{2a+1}N(CH_3)(W)_3(A)_nB^-X^+ \qquad (3)--$$

Signed and Sealed this

Fourteenth Day of April, 1998

Bruce Lehman

*Attest:*

BRUCE LEHMAN

*Attesting Officer*

*Commissioner of Patents and Trademarks*